US007034237B2

(12) United States Patent
Ferri et al.

(10) Patent No.: US 7,034,237 B2
(45) Date of Patent: Apr. 25, 2006

(54) PORTABLE ELECTRONIC INSTRUMENT INCLUDING AT LEAST ONE CONTROL MEMBER ARRANGED FOR ALSO TRANSMITTING ELECTRIC SIGNALS

(75) Inventors: Yvan Ferri, Lausanne (CH); Rudolf Dinger, Saint-Aubin (CH)

(73) Assignee: Asulab S.A., Marin (CH)

( * ) Notice: Subject to any disclaimer, the term of this patent is extended or adjusted under 35 U.S.C. 154(b) by 0 days.

(21) Appl. No.: 10/945,134

(22) Filed: Sep. 20, 2004

(65) Prior Publication Data

US 2005/0061646 A1 Mar. 24, 2005

(30) Foreign Application Priority Data

Sep. 23, 2003 (EP) ..... 03010126
Sep. 23, 2003 (EP) ..... 03021443

(51) Int. Cl.
*H01H 3/12* (2006.01)

(52) U.S. Cl. ..... 200/341; 200/5 A

(58) Field of Classification Search ..... 200/308–314, 200/341–345, 5 A, 5 R, 51 R
See application file for complete search history.

(56) References Cited

U.S. PATENT DOCUMENTS

| | | | | |
|---|---|---|---|---|
| 4,170,104 | A * | 10/1979 | Yamagata | 368/289 |
| 6,494,615 | B1 * | 12/2002 | Wyssbrod | 368/319 |
| 6,846,998 | B1 * | 1/2005 | Hasumi et al. | 200/341 |
| 6,872,899 | B1 * | 3/2005 | Oshio et al. | 200/43.13 |
| 2002/0033323 | A1 * | 3/2002 | Ehrensberger | 200/302.2 |
| 2004/0262143 | A1 * | 12/2004 | Camillo | 200/553 |

FOREIGN PATENT DOCUMENTS

| | | |
|---|---|---|
| EP | 1 109 084 | 6/2001 |
| EP | 1 134 630 | 9/2001 |
| EP | 1 168 113 | 1/2002 |

* cited by examiner

*Primary Examiner*—Lisa N. Klaus
(74) *Attorney, Agent, or Firm*—Sughrue Mion, PLLC

(57) ABSTRACT

There is disclosed a portable electronic instrument (1) including a case (2) and a user interface (11 to 15) for selecting the functions of said portable electronic instrument, this user interface including at least a first control member (11) mounted to be mobile in an assembly orifice (3*a*) arranged in the case so as to have a translation travel along an axis of actuation (X—X), said control member being able to be actuated by pressure to be brought from a position called the non pushed-in position to a position called the pushed-in position and to generate in response a control signal (SEL). The control member includes an electrically conductive stem (100) which passes through the assembly orifice and which includes first and second ends opening out respectively inside and outside the case, said stem being adapted to allow transmission of electric signals from and/or to the portable electronic instrument, when the control member is brought into said pushed-in position. This electronic instrument further includes means (3, 30, 40; 35, 40) for bringing the stem of the control member to a determined electric potential when the control member occupies the non pushed-in position and for interrupting the connection of the stem of the control member to the determined electric potential when the control member occupies said pushed-in position and for thus allowing transmission of said electric signals from and/or to the portable electronic instrument.

12 Claims, 9 Drawing Sheets

PORTABLE ELECTRONIC INSTRUMENT INCLUDING AT LEAST ONE CONTROL MEMBER ARRANGED FOR ALSO TRANSMITTING ELECTRIC SIGNALS

This application claims priority from European Patent Application No. 03010126.5 filed Sep. 23, 2003, the entire disclosure of which is incorporated herein by reference.

FIELD OF THE INVENTION

The present invention concerns generally a portable electronic instrument, particularly a timepiece, including a case and a user interface for selecting the functions of the portable electronic instrument, this user interface including a least a first control member mounted so as to be mobile in an assembly orifice arranged in the case so as to have a translation travel along an axis of actuation, this control member being able to be actuated by pressure to be brought from a position called the non-pushed in position to a position called the pushed-in position and to generate in response a control signal, the control member including an electrically conductive stem which passes through the assembly orifice and which includes first and second ends opening out respectively inside and outside the case, this stem being adapted to allow transmission of electric signals from and/or to the portable electronic instrument when the control member is brought into its pushed-in position.

BACKGROUND OF THE INVENTION

Electronic instruments answering the general definition mentioned hereinbefore are already known. EP Patent Application No. 1 109 084 A1 and EP Patent Application 1 134 630 A1 for example disclose such electronic instruments. EP Patent Application No. 1 109 084 A1 discloses in particular such a solution wherein at least one control member of the aforementioned type is exploited to recharge an electric accumulator housed in the instrument whereas EP Patent Application No. 1 134 630 A1 discloses a solution wherein at least one control member is exploited to transmit and/or receive data from the electronic instrument.

The advantage of these prior art solutions (which also goes for the present invention) lies in the use of one or more control members (conventionally of the push-button type) for electrically connecting the electronic instrument to an external unit, for example a personal computer. Consequently, no specific contact element is necessary to establish an electrical connection between the electronic instrument and the external unit, this electrical connection being established as soon as the control member or members configured to have the aforementioned dual function are brought into the pushed-in position.

One peculiarity of the two aforementioned prior solutions lies in the use of the retaining element of the control member (similar to a retaining key) as the contact element for fulfilling the conventional function of the control member, namely controlling the functions of the electronic instrument. Another peculiarity of these prior solutions lies in the fact that the stem of the control member, in the non-pushed in position, is floating from the electrical point of view. In the non-pushed in position, electric charges are thus able to accumulate on the stem of the control member. When the control member is actuated, this accumulation of electric charges can then be carried across the terminals with which the control member is brought into contact and cause damage, in particular to the electronic circuit of the instrument. This constitutes a critical problem for solutions of the aforementioned type, given that the control member fulfils two functions and it establishes a direct connection with sensitive components of the electronic circuit of the instrument, in particular its processor unit and the associated memories.

One solution to overcome this problem can consist in protecting the terminals with which the control member is brought into contact by means of electric protective components allowing a path to be established for discharging the accumulated electric charges. These are well known protective components, called ESD ("electro-static-discharge") components. It is, however, desirable to find a solution that ensures that the electric charges cannot accumulate in the first place on the stem of the control member when the latter is in the non-pushed in position.

SUMMARY OF THE INVENTION

The present invention thus concerns a portable electronic instrument including a case and a user interface for selecting the functions of said portable electronic instrument, said user interface including at least a first control member mounted to be mobile in an assembly orifice arranged in said case so as to have a translation travel along an axis of actuation, said control member being able to be actuated by pressure to be brought from a position called the non pushed-in position to a position called the pushed-in position and to generate in response a control signal, said control member including an electrically conductive stem which passes through said assembly orifice and which includes first and second ends opening out respectively inside and outside said case, said stem being adapted to allow transmission of electric signals from or to the portable electronic instrument, when said control member is brought into said pushed-in position, wherein said electronic instrument further includes means for bringing the stem of the control member to a determined electric potential when said control member occupies said non pushed-in position and for interrupting the connection of the stem of the control member to said determined electric potential when said control member occupies said pushed-in position and for thus allowing transmission of said electric signals from or to the portable electronic instrument.

Advantageous embodiments of the present invention form the subject of the dependent claims.

The proposed solution consists in providing means for bringing the stem of the control member to a determined electric potential when the control member occupies the non-pushed in position and for interrupting the connection of the stem of the control member to the determined electric potential when the control member occupies the pushed-in position and thus allowing transmission of electric signals from and/or to the electronic instrument.

According to a preferred embodiment, the aforementioned means are formed by an axial retaining element of the control member made of an electrically conductive material. This retaining element is brought, in the non pushed-in position, into contact with an electrically conductive reference element (which can advantageously be a part of the case of the electronic instrument), which is brought to a determined electric potential, the contact of the retaining element with this reference element being interrupted when the control member is brought into the pushed-in position. This retaining element can be shaped like a conventional retaining key.

According to another preferred aspect, the control member co-operates with a first electric contact actuated by the first end of the stem to generate the conventional control signal, this first end of the stem being electrically insulated by an insulating sheath to prevent any direct electrical contact with the first electric contact. According to this preferred aspect, the control member also co-operates with a contact strip that is distinct from the first electric contact, this electric contact being electrically insulated from the stem in the non pushed-in position and electrically connected to the stem in the pushed-in position to allow transmission of electric signals from and/or to the electronic instrument.

BRIEF DESCRIPTION OF THE DRAWINGS

Other features and advantages of the present invention will appear more clearly upon reading the following detailed description of various embodiments of the invention given solely by way of non-limiting examples and illustrated by the annexed drawings, in which.

DESCRIPTION OF PREFERRED EMBODIMENTS

As already mentioned, the invention proceeds from the general idea that consists in connecting a portable electronic instrument (for example a wristwatch) to an external electrical or electronic device via at least one control member of the user interface with which the portable electronic instrument is fitted. "Transmission of electric signals" will cover in particular the application of electric signals for the purpose of recharging an electric accumulator with electrical energy and the communication of data to and/or from the portable electronic instrument. The external device can thus be an electrical charging device or an electronic communication device, for example a personal computer.

Within the scope of the present invention, it will be understood that the control member or members thus configured fulfil two functions, namely their first control function for selecting functions of the portable electronic instrument (selection of operating or data modes, data updating or settings for the portable electronic instrument, for example the time and/or the date, etc.) and the additional function of means for transmitting electric signals.

It will also be understood that the transmission of electric signals (for example for recharging an accumulator and/or data communication) can be established as soon as the control members configured for this purpose are brought into the pushed-in position. Connection of the portable electronic instrument to the external electrical or electronic device will thus be established owing to an adaptor arranged for bringing the control members concerned into the pushed-in position. This adaptor will not be described here since it does not directly concern the subject of the present invention. In the following description, one need only understand that this adaptor is preferably arranged to act as a recharging device for an electrical energy accumulator and as communication interface with an external processing unit, such as a personal computer. It is not, however, necessary for the control members to be configured to fulfil these two functions.

The present invention will be described with reference to a timepiece advantageously taking the form of a wristwatch. The invention nonetheless applies in an identical manner to any portable electronic instrument whether or not it fulfils a horological function.

Figure 1:
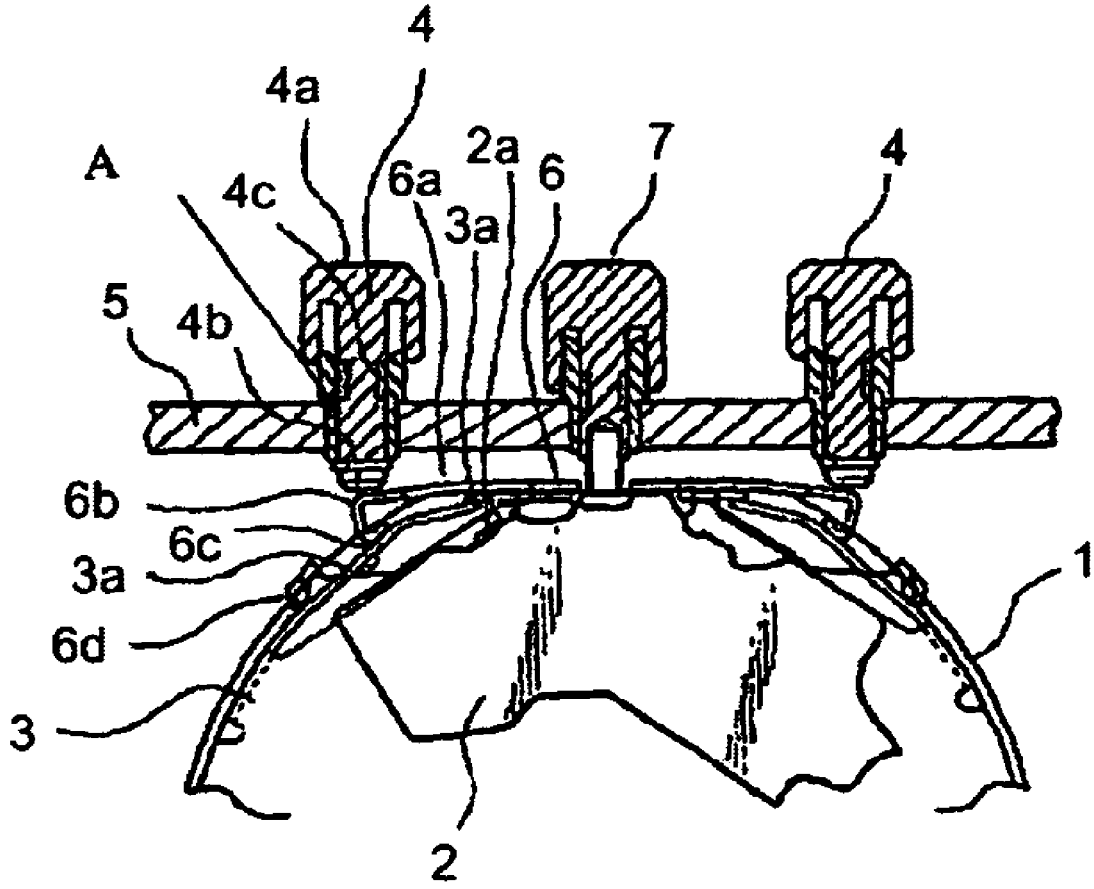
FIG. 1 shows a general plan view of an electronic instrument according to the invention shown advantageously here in the form of a wristwatch including a plurality of control members of the push-button type.

FIG. 1 shows a plan view of the whole of a wristwatch, designated as a whole by the reference numeral 1, forming an implementation example of the invention. It includes in particular a case 2 delimited in this example by a bottom part 3 forming the middle part and back cover, and a top part 4 forming the bezel, which also carries a glass 5. Bezel 4 is fitted onto middle part 3 in a conventional manner, a sealing gasket being inserted between these elements to assure sealing of case 2.

In this example, five control members of the push-button type pass through middle part 3, respectively designated by the reference numerals 11, 12, 13, 14 and 15. It goes without saying that this example is given solely by way of illustration and that, in order to implement the present invention, the instrument need include at least one control member configured as will be described hereinafter. The five control members 11 to 15 together form a user interface with which the user can interact to select the various functions of wristwatch 1.

Control members 11 to 15 are placed laterally here on middle part 3 at typical locations for a wristwatch, namely substantially at 2 o'clock, 3 o'clock, 4 o'clock, 8 o'clock and 10 o'clock respectively. It goes without saying that control members 11 to 15 could be arranged at other locations. At least one of the control members could thus be placed on the front face of the watch, for example at 6 o'clock.

In the following description, we will be concerned only with the structure of control member 11. In this example, control members 12, 13, 14 and 15 have a similar configuration. More particularly, the two control members 11 and 13 form input/output terminals for establishing communication with at least one electronic unit housed inside case 2, whereas control members 14 and 15 are used for recharging an electrical energy accumulator of the portable electronic instrument. Control unit 12 is only used as reserve and could be configured like a conventional control member for fulfilling only its control role. This control member 12 could also be configured like a conventional stem-crown for setting the time of the watch.

Figure 2A:
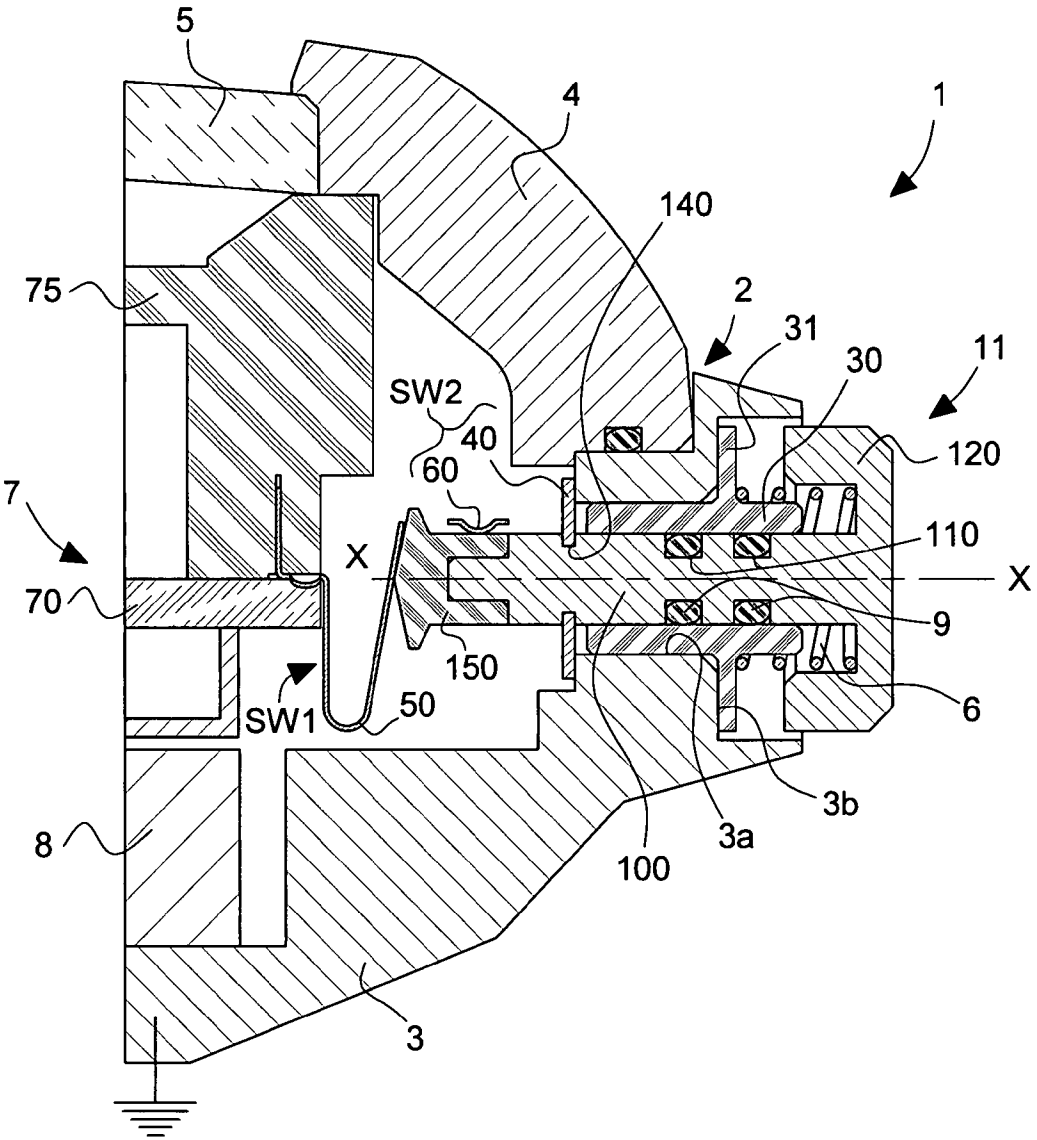
FIG. 2*a* is a cross-sectional view of one of the control members of the instrument of FIG. 1 according to a first embodiment, this control member being illustrated in its non pushed-in position.

FIG. 2*a* shows a partial cross-sectional view of FIG. 1 taken at control member 11 along its axis of actuation designated X—X. As already mentioned, control members 12, 13, 14 and 15 have a similar configuration. Control member 11 is mounted so as to be mobile in an assembly orifice 3*a* arranged in middle part 3 so as to have a translation travel along axis of actuation X—X. Control member 11 can be actuated by pressure, like a conventional push-button, to be brought from a first position called the non-pushed-in position, as illustrated in FIG. 2*a*, into a second position, called the pushed-in position illustrated in FIG. 2*b*.

Control member 11 is made up mainly of a stem 100, of elongated shape, made of an electrically conductive material, advantageously of metal. This stem 100 preferably, but not exclusively, has a cylindrical shape and passes right through middle part 3. A first end of stem 100 thus opens out inside the cavity formed by middle part 3 whereas the second end of stem 100 opens out outside middle part 3 so as to be able to be actuated by a user. Sealing is assured in a conventional manner by one or several O-ring joints 9 housed in one or several grooves 110 arranged on stem 100.

Stem 100 can be made in a single piece. This stem could however, be made in two parts, one made of ordinary conductive material (for example an ordinary stainless steel, for example 4C27A steel) and the other, secured to the first, of a corrosion-resistant material (for example an efficient stainless steel of the 316L steel type). It would in fact be advantageous to make the exposed part of stem 100 in this latter material to prevent any corrosion via the effect of sweat or friction, the remainder of the stem can be made of an ordinary conductive material.

On its second end, stem 100 ends in a head 120 of larger diameter. In this example, stem 100 and head 120 of the control member are made in one piece. By way of alternative, it is perfectly possible to envisage making these two elements separately and then securing them to each other or even overmoulding a head of plastic material on conductive stem 100. In order to fulfil the desired electric signal transmission function, it will be understood that in any case electric access should be assured to stem 100 from the exterior. Overmoulding or mounting a plastic head on the stem should thus be such that the external end of the stem can be electrically contacted from the exterior.

Middle part 3 is preferably also made of an electrically conductive material, stem 100 being consequently insulated from middle part 3 by an insulating sleeve 30. In this preferred example, middle part 3 is also brought, during operation, to a determined electrical potential, here the earth potential of the portable instrument as schematised in the Figures. The usefulness of this electrical connection will appear more clearly in the following description. Middle part 3 could alternatively be made of a non conductive material, in which case sleeve 30 is no longer necessary (an additional conductive element brought to the determined electric potential being then required as will be seen hereinafter).

Insulating sleeve 30 has a generally tubular shape with a shoulder 31 arranged to abut, from outside middle part 3, on a corresponding shoulder 3*b* arranged in assembly orifice 3*a*. This insulating sleeve 30 is thus introduced into assembly orifice 3*a* from the exterior and is preferably secured to middle part 3, for example by being driven in, screwed in or bonded. This sleeve 30 can advantageously be made of eloxated aluminium, plastic material, ceramic material, or any other material insofar as at least the contact surface between sleeve 30 and the neighbouring conductive parts is electrically insulated.

Figure 2B:
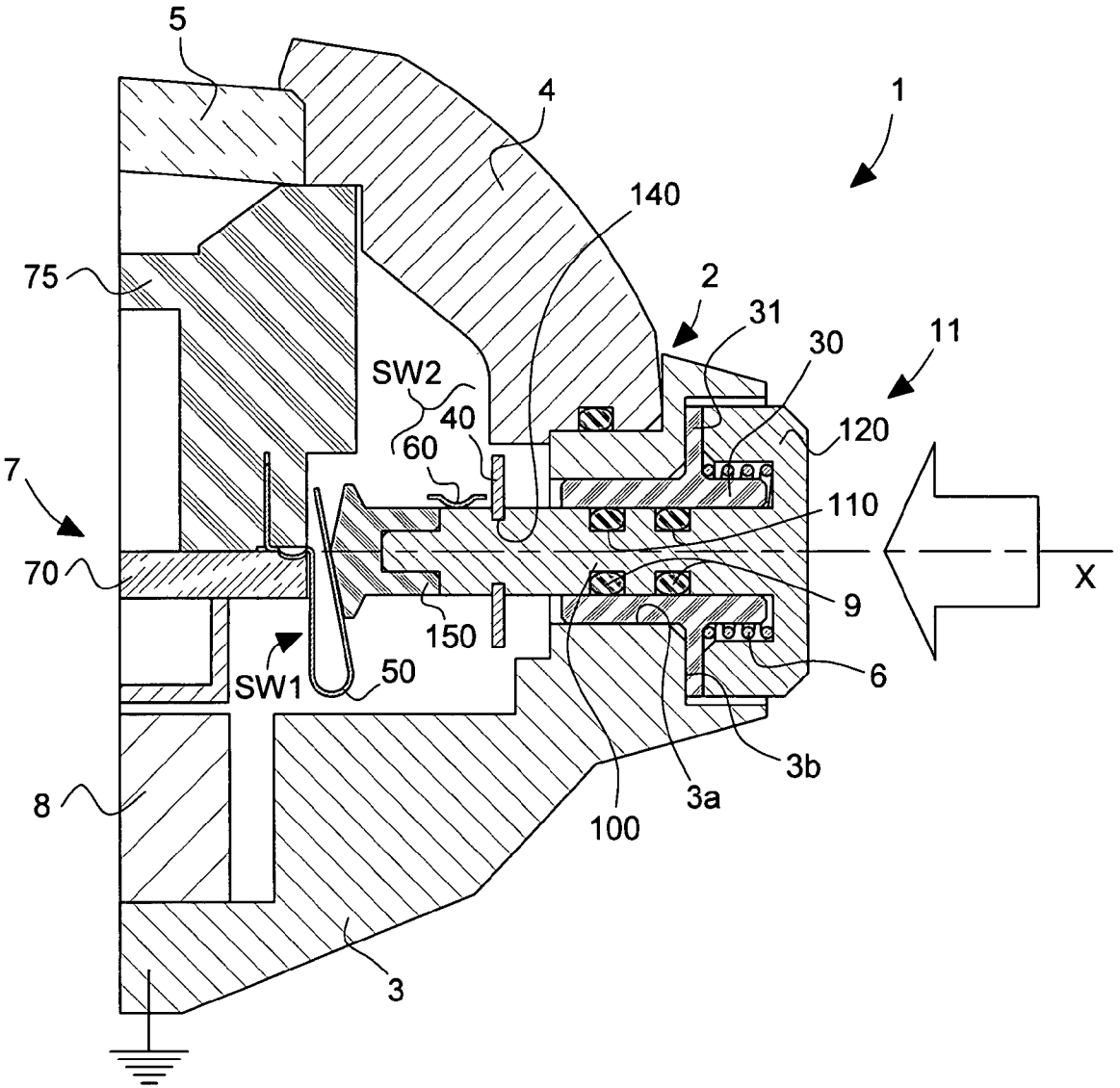
FIG. 2*b* is a similar cross-sectional view to that of FIG. 2*a* in which the control member is illustrated in the pushed-in position.

Elastic return means 6, formed in this example of a helical spring, is placed between shoulder 31 of insulating sleeve 30 and head 120 of the control member. When pressure is applied onto the control member, return means 6 is thus compressed between shoulder 31 and head 120 as illustrated in FIG. 2*b*, thus exerting a return force tending to bring the control member back from its pushed-in position to its non-pushed-in position. It will be noted that shoulder 31 of the insulating sleeve also assures that head 120 of the control member, which is conductive here, does not come back into contact with middle part 3.

The control member also includes a retaining element 40 adapted to retain stem 100 of the control member axially. For this purpose, retaining element 40 is secured to stem 100 and is placed on the inner side of middle part 3 in order to act against the action of return means 6 which tends to extract the control member from its housing. Retaining element 40 is advantageously configured like a traditional retaining key, which is introduced into a groove 140 arranged on stem 100. This retaining element 40 is also made of an electrically conductive material.

In FIG. 2*a*, it can be seen that in the non-pushed-in position, retaining element 40 abuts onto middle part 3, at the periphery of assembly orifice 3*a*. Consequently, an electrical connection is assured, in the non-pushed-in position, between stem 100 of the control member and middle part 3. Stem 100 of the control member is thus brought to the same electrical potential as middle part 3. In the pushed-in position, however, this electrical connection is interrupted because of the axial movement of retaining element 40, which accompanies the movement of stem 100.

Figure 4:
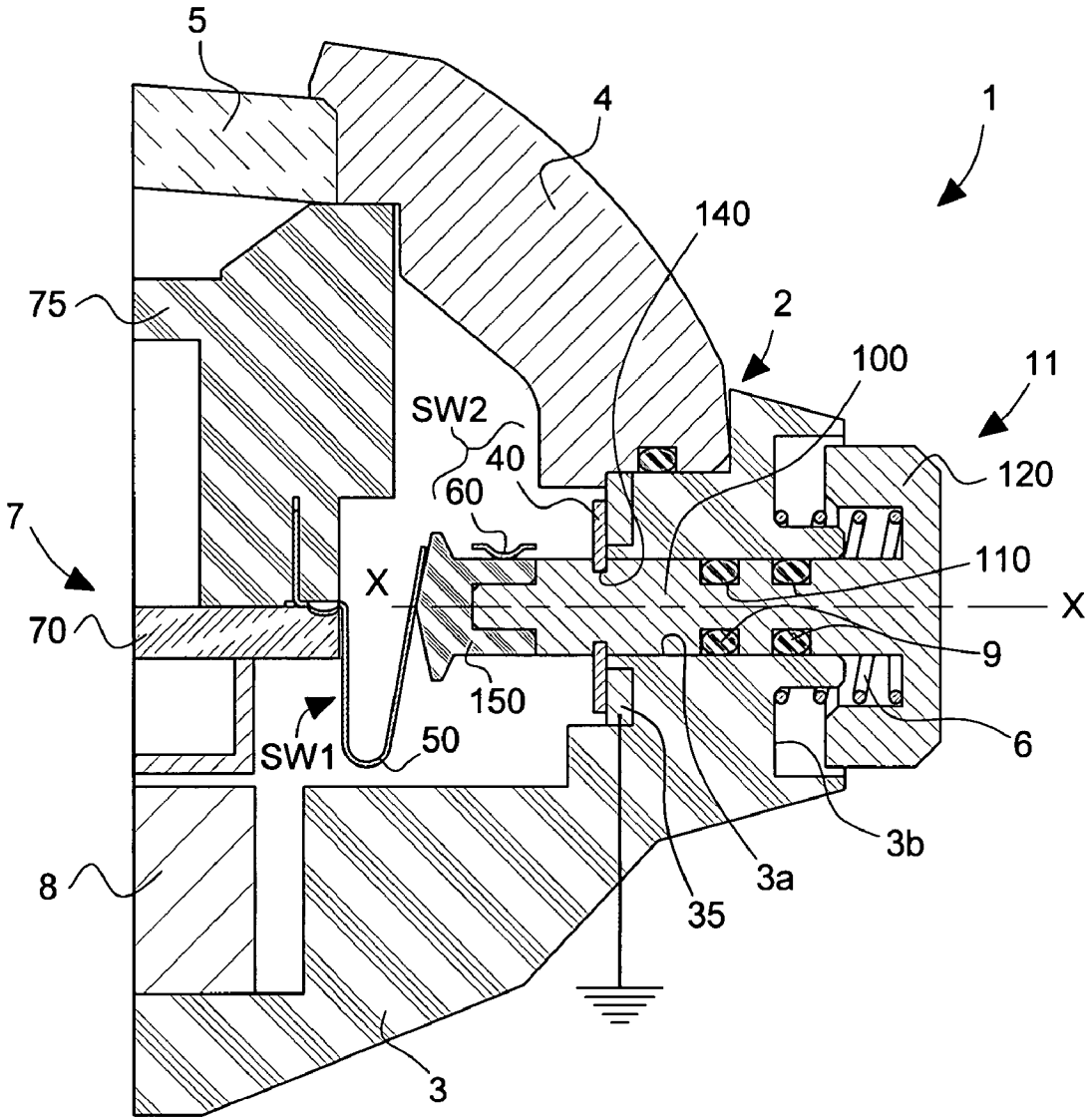
FIG. 4 is a similar cross-sectional view to that of FIG. 3*a* showing an alternative embodiment.

As mentioned hereinbefore, middle part 3 could be made of a non-conductive material, for example plastic, insulating sleeve 30 then no longer being necessary. In order to bring stem 100 of the control member to a determined electric potential, a conductive reference element, brought to said determined electric potential, should thus be placed in proximity to stem 100 and stem 100 should be brought into contact with this reference element in the non pushed-in position. FIG. 4 shows a variant in which middle part 3 is not made of an electrically conductive material, making the use of insulating sleeve 30 unnecessary and in which such a reference element 35, for example a metallic ring fixed inside middle part 3, is inserted between retaining element 40 and middle part 3. This reference element 35 could, for example, form an integral part of bezel 4, the latter then being made of an electrically conductive material.

In the aforementioned embodiments, stem 100 is advantageously and preferably brought to the determined electric potential by retaining element 40. In order to implement the invention, it is however possible to envisage assuring this electric connection by other means. A contact strip for setting the determined electric potential could for example be arranged to cooperate with stem 100 such that electric contact with stem 100 is established in the non pushed-in position and interrupted in the pushed-in position (by analogy with the contact strip bearing the reference numeral 60 in FIGS. 2*a* and 2*b*, the use of which is explained hereinafter).

Generally, it will thus have been understood that the structure of the control member is such that, in the non-pushed-in position, stem 100 of the control member is brought to a determined electrical potential, thus making the accumulation of electric charges on said stem impossible. In the pushed-in position, however, this electrical connection is interrupted, thus making the transmission of electric signals possible, via stem 100.

We will now examine more particularly the proposed configuration of the control device and structure of the electric contacts, which assure, on the one hand, the first control member function and, on the other hand, the additional function of electric signal transmission means.

Figure 3:
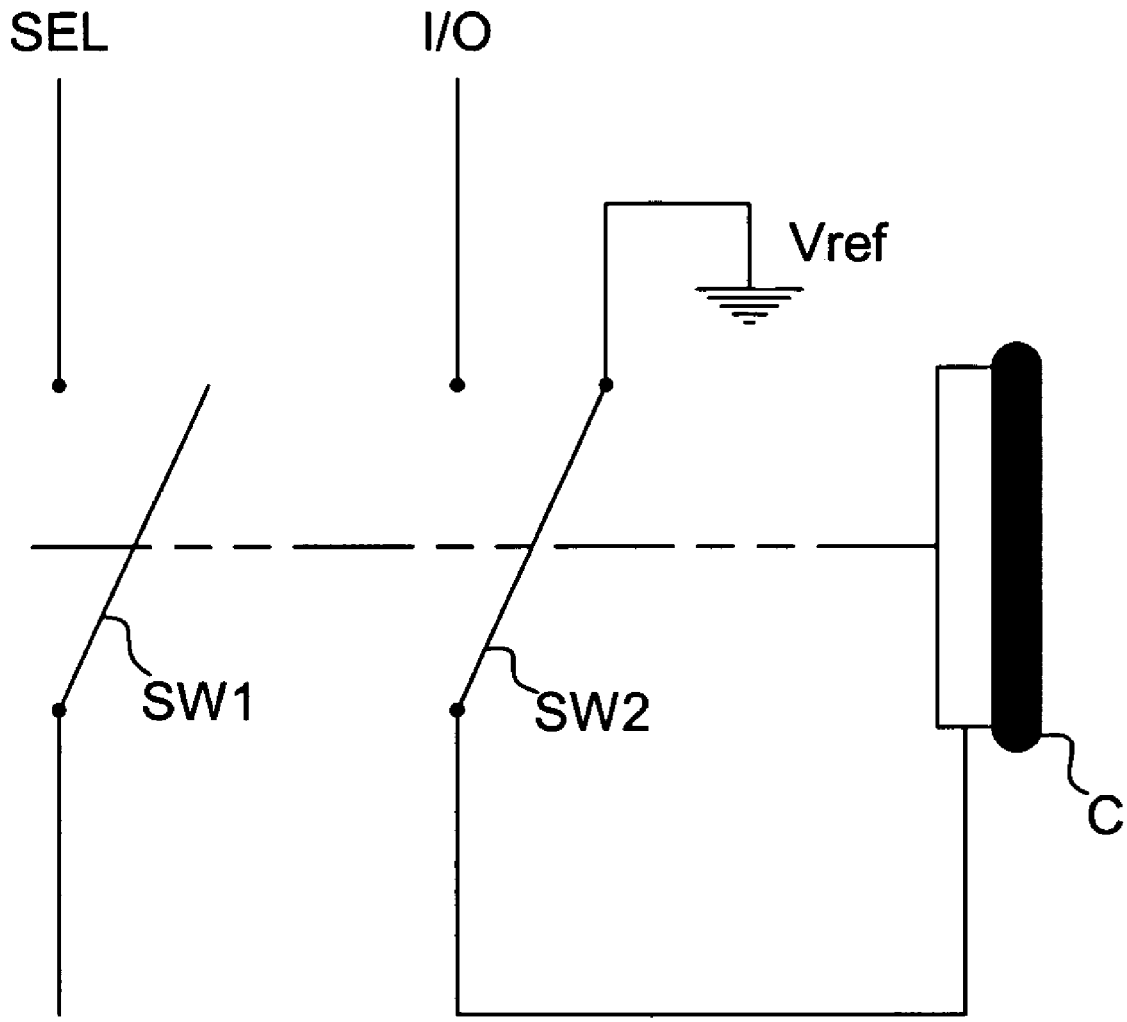
FIG. 3 is a schematic view of the configuration and operation of the control member of FIGS. 2*a* to 2*d* in which, in addition to its conventional control function, this control member fulfils an additional function allowing transmission of electrical signals from and/or to the electronic instrument.

FIG. 3 shows a view of the principle of the configuration and operation of the control device envisaged for allowing the control member to fulfil, in addition to its conventional control function, an additional function for transmitting electric signals from and/or to the electronic instrument. The control member is shown schematically in this Figure and bears the reference C. This control member C cooperates with a first electric contact SW1 in a conventional manner in order to fulfil its control function. A control signal SEL is thus produced in response to activation of electric contact SW1, namely in response to pressure on control member C. A second electric contact SW2, distinct from the first contact SW1 assures connection with an input/output line I/O connected for example to a processing unit housed inside the portable electronic instrument. This second electric contact SW2 fulfils an additional function for establishing an electric connection between the input/output I/O and control member C, or more exactly the stem of this control member C. This possibility is schematised in FIG. 3 by the connection of control member C and input/out I/O through electric contact SW2. This connection is only established when control member C is brought into the pushed-in position to close electric contact SW2. In the non-pushed-in position, electric contact SW2 connects, as schematised, control member C to a determined electric potential VREF shown here as an electric potential forming earth. It will have been understood that the first and second electric contacts SW1 and SW2 are independent but are nonetheless actuated simultaneously in response to pressure on control member C.

The peculiarity of the proposed control member lies essentially in the fact that, in the non-pushed-in position, the electrically conductive part of control member C, which acts as electric connecting means with the input/output I/O (namely the stem of the control member), is not left in the floating state but is brought to a determined electric potential, thus preventing any accumulation of electric charges on this part of the control member.

With reference again to FIGS. 2*a* and 2*b*, a preferred embodiment of the aforementioned electric contacts will now be described. In these Figures, it can be seen that middle part 3 defines an inner cavity occupied, in a conventional manner, by an electronic module 7 (shown partially in FIG. 2*a*) including in particular a printed circuit board, or PCB, 70 carrying various electric and electronic components (not shown in these Figures) including a data processing unit (for example a microcontroller or a microprocessor), storage means (for example EEPROM, FLASH or similar) and other components for implementing the functions of wristwatch 1. Horological components (time base, frequency divider analogue and/or digital display means, etc.) are in particular conventionally provided in this example to fulfil various horological functions, including in particular the time display. Reference 75 indicates an optional element forming a spacer arranged on the top face of PCB 70 and which carries in particular the display means of the electronic instrument.

In FIGS. 2*a* and 2*b*, an electric energy source 8 has also been partially shown, for powering the aforementioned electronic module 7. This may be a conventional battery or a rechargeable accumulator (which can for example be recharged via at least one of the control members as already mentioned).

Figure 2C:
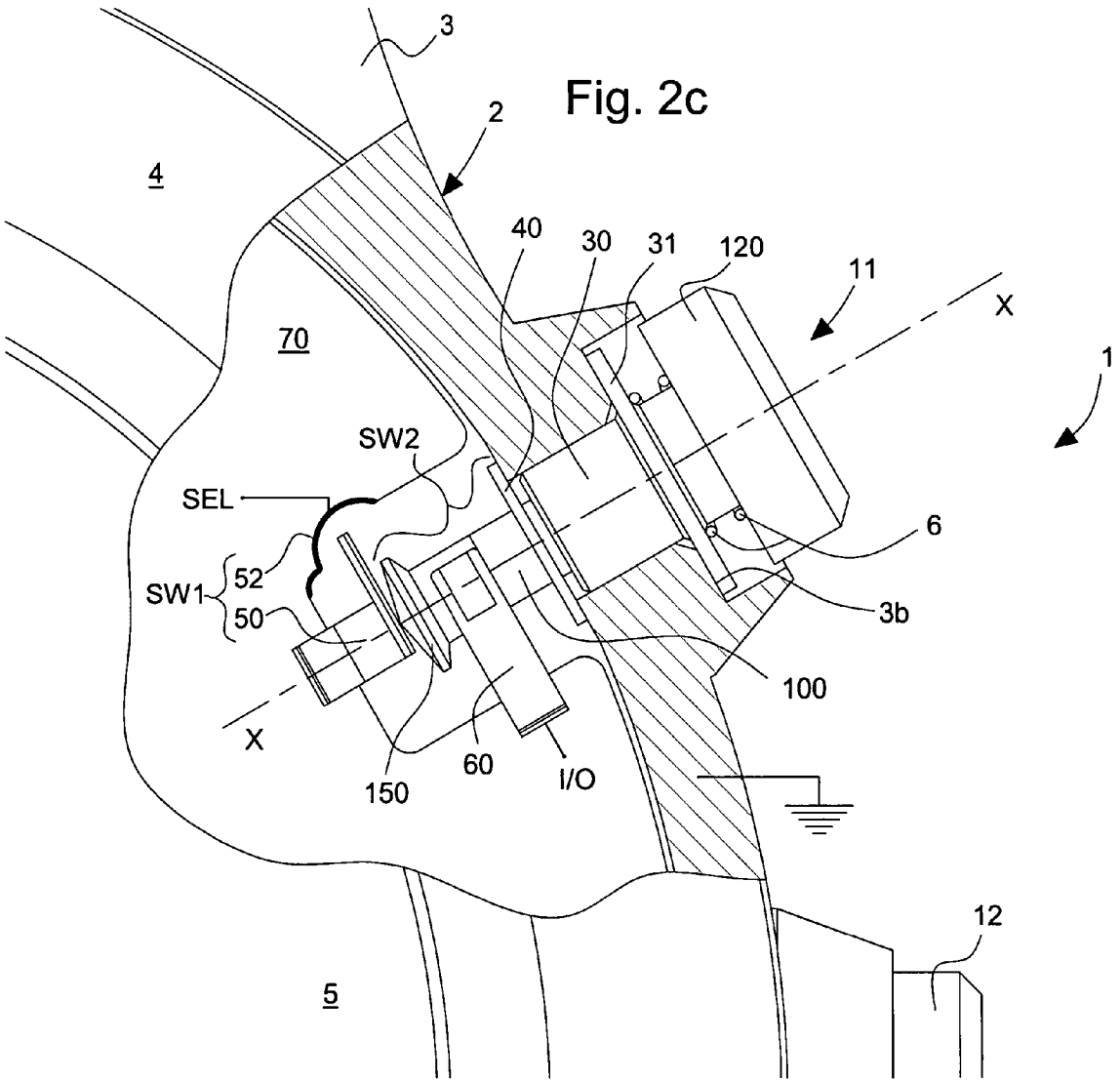
FIG. 2*c* is a partial plan view of the control member of FIG. 2*a* in its non pushed-in position.
Figure 2D:
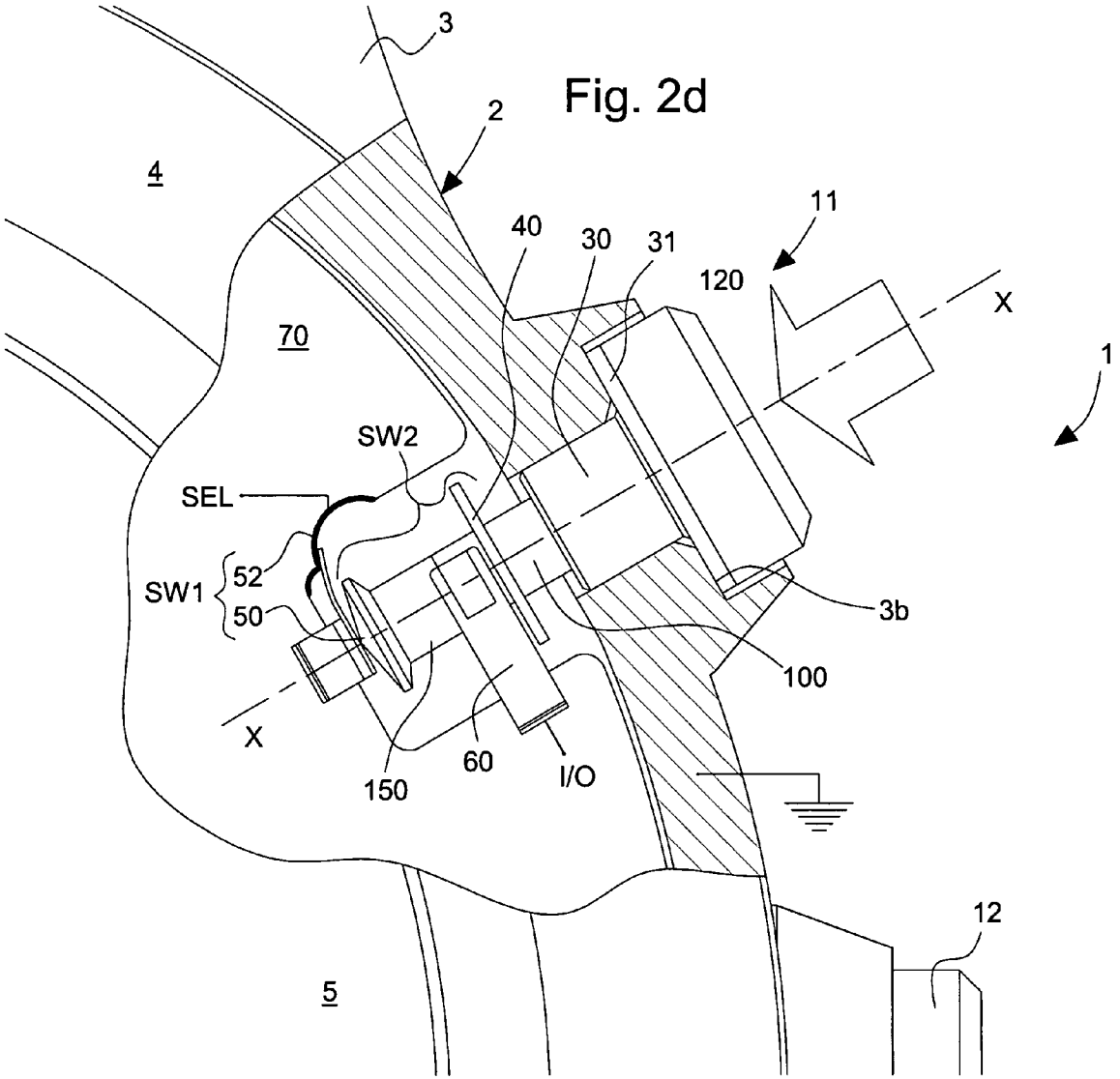
FIG. 2*d* is a similar plan view to that of FIG. 2*c* in which the control member is illustrated in the pushed-in position.

In this embodiment, the first electric contact SW1 of FIG. 3 is made in a conventional manner in the form of an electric contact strip 50 including a base secured to electronic module 7 (this base is held here between PCB 70 and spacer 75) and a flexible extension, which cooperates with the end of stem 100, this end being electrically insulated from contact strip 50 by an insulating sheath 150 able to be made in a similar material to that of insulating sleeve 30. The flexible extension of contact strip 50 is arranged to be brought conventionally into contact with the other part of the first electric contact (not shown in FIGS. 2*a* and 2*b*). In this particular case, it is a metallisation 52 formed on the edge of PCB 70 as illustrated in the partial plan view of FIG. 2*c*. In this FIG. 2*c*, spacer 75 has not been shown in order to uncover the whole of the control device. FIG. 2*d* shows a similar plan view to that of FIG. 2*c*, control member 11 in the pushed-in position, where one can see the flexible extension of contact strip 50 coming into contact with metallisation 52.

The function of the second electric contact SW2 of FIG. 3 is achieved owing to retaining element 40 secured to stem 100 and to a second electric contact strip 60 arranged tangentially to stem 100 in proximity to its end covered by insulating sheath 150. This electric contact strip 60 is also held by its base between PCB 70 and spacer 75. Consequently, in the non-pushed-in position (FIGS. 2*a* and 2*c*), electric contact strip 60 is in contact insulating sheath 150 and in the pushed-in position (FIGS. 2*b* and 2*d*), electric contact strip 60 is in contact with stem 100.

In FIGS. 2*a* to 2*d*, it can be seen that insulating sheath 150 fulfils two functions, namely the electric insulation between stem 100 and the first electric contact (whatever the position of the control member) and the electric insulation between stem 100 and electric contact strip 60 (only in the non-pushed-in position). Electric contact strip 60 could of course cooperate with an insulating sheath distinct from insulating sheath 150.

It will also be noted that insulating sheath 150 ends here in a portion of larger diameter. This feature is not necessary but prevents any electric contact between strips 50 and 60, the portion of larger diameter being inserted between these two strips.

Figure 5A:
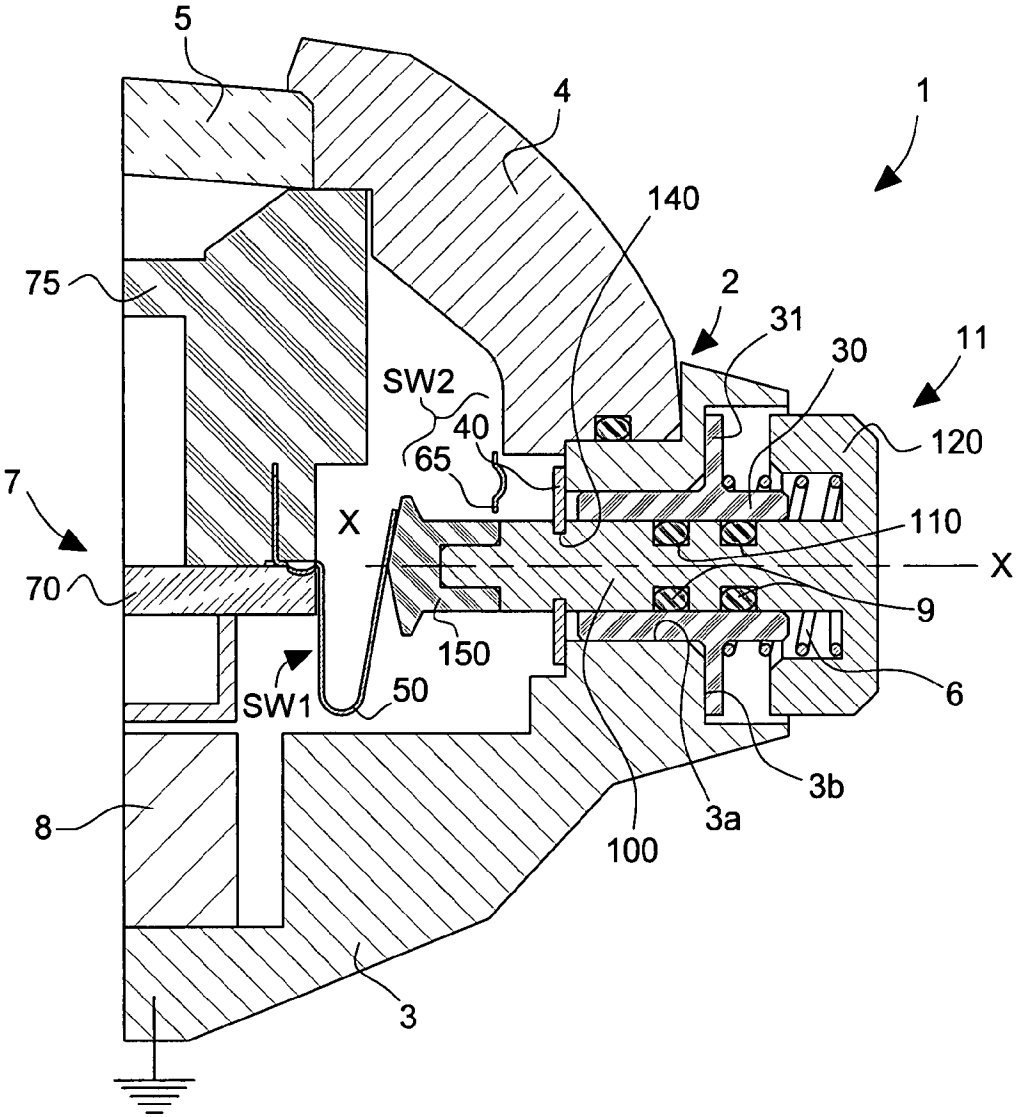
FIGS. 5*a* and 5*b* are similar cross-sectional views to those of FIGS. 2*a* and 2*b* respectively, showing yet another variant.
Figure 5B:
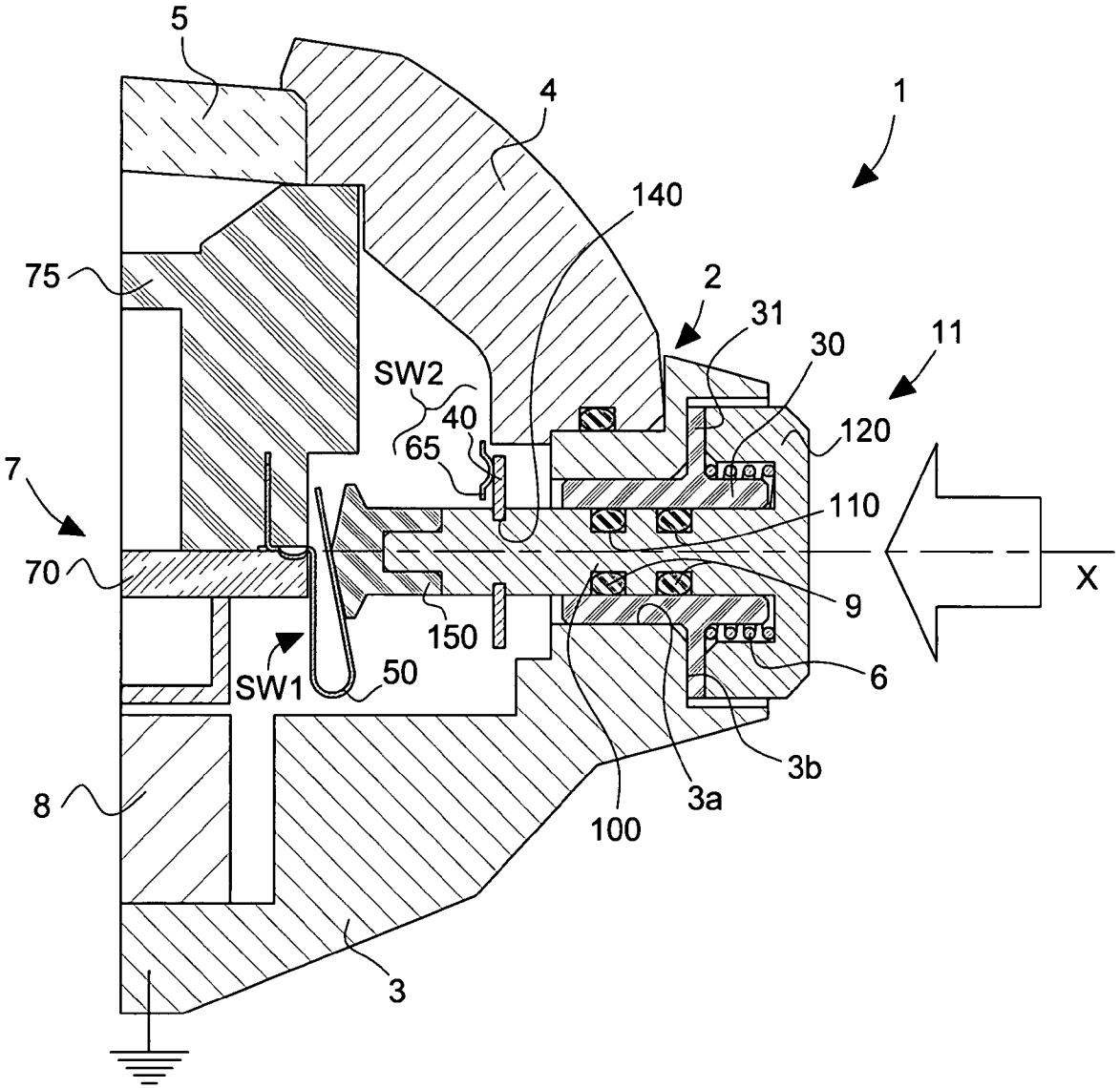

By way of alternative to the solution of FIGS. 2*a* to 2*d*, electric contact strip 60 could be replaced by a contact strip not cooperating directly with stem 100 but with retaining element 40. Such a contact strip could for example be arranged facing the retaining element such that an electrical connection is established with stem 100, via retaining element 40 when the control member is brought into its pushed-in position. Such a variant is illustrated in FIGS. 5*a* and 5*b* where it can be seen that the previously used contact strip 60 is replaced by another contact strip 65 arranged facing retaining element 40.

It will be understood that various modifications and/or improvements evident to those skilled in the art can be made to the embodiments described in the present description without departing from the scope of the invention defined by the annexed claims. In particular, the present invention is not limited solely to use in a wristwatch but applies to any other application in a portable electronic instrument.

The invention claimed is:

1. A portable electronic instrument including a case and a user interface for selecting the functions of said portable electronic instrument, said user interface including at least a first control member mounted to be mobile in an assembly orifice arranged in said case so as to have a translation travel along an axis of actuation, said control member being able to be actuated by pressure to be brought from a position called the non pushed-in position to a position called the pushed-in position and to generate in response a control signal, said control member including an electrically conductive stem which passes through said assembly orifice and which includes first and second ends opening out respectively inside and outside said case, said stem being adapted to allow transmission of electric signals from or to the portable electronic instrument, when said control member is brought into said pushed-in position, wherein said electronic instrument further includes means for bringing the stem of the control member to a determined electric potential when said control member occupies said non pushed-in position and for interrupting the connection of the stem of the control member to said determined electric potential when said control member occupies said pushed-in position and for thus allowing transmission of said electric signals from or to the portable electronic instrument.

2. The portable electronic instrument according to claim 1, wherein said control member is retained axially in said case by a retaining element secured to said stem and made of an electrically conductive material, said retaining element being brought, when said control member occupies said non pushed-in position, into contact with an electrically conductive reference element which is brought to said determined electric potential, the contact of said retaining element with said reference element being interrupted when said control member is brought to the pushed-in position.

3. The portable electronic instrument according to claim 2, wherein said case includes at least one part made of an electrically conductive material and in which said control member is mounted, said part forming said reference element brought to said determined electric potential, the stem of said control member being electrically insulated from said electrically conductive part of the case by an insulating sleeve introduced into said assembly orifice of the control member.

4. The portable electronic instrument according to claim 3, wherein said retaining element is arranged on said stem inside said case, wherein said insulating sleeve includes a shoulder abutting a corresponding shoulder arranged on said assembly orifice outside said case, and wherein said control member further includes a head secured to the second end of the stem and having a larger diameter than the diameter of the stem, elastic return means being arranged between said shoulder of the insulating sleeve and said head of the control member in order to return said control member from its pushed-in position to its non pushed-in position after actuation.

5. The portable electronic instrument according to claim 4, wherein said insulating sleeve is made of eloxated aluminium, plastic material, ceramic material, or any other material including an electrically insulating external surface.

6. The portable electronic instrument according to claim 5, wherein said retaining element is configured like a push-button retaining key.

7. The portable electronic instrument according to claim 6, wherein said control member cooperates with a first electric contact actuated by the first end of the stem to generate said control signal; said first end of the stem being electrically insulated by an insulating sheath to prevent any direct electric contact with said first electric contact, and wherein said control member further cooperates with an electric contact strip distinct from said first electric contact, said electric contact strip being electrically insulated from said stem in the non pushed-in position and electrically connected to said stem in the pushed-in position to allow said transmission of electric signals from or to the electronic instrument.

8. The portable electronic instrument according to claim 7, wherein said electric contact strip is arranged tangentially to said stem in proximity to said first end of the stem such that, in the non pushed-in position, the electric contact strip is in contact with said insulating sheath and such that, in the pushed-in position, the electric contact strip is in contact with said stem.

9. Portable electronic instrument according to claim 7, wherein said electric contact strip is not arranged in direct contact with the stem of said control member, said electric contact strip being arranged facing said retaining element such that an electric connection is established with the stem, via said retaining element, when said control member is brought into said pushed-in position.

10. The portable electronic instrument according to claim 7, wherein said insulating sheath is made of eloxated aluminium, plastic material, ceramic material or any other material including an electrically insulating external surface.

11. The portable electronic instrument according to claim 7, wherein said interface further includes second, third and fourth control members configured in a similar manner to said first control member, said first and second control members being exploited to exchange data with said electronic instrument, said third and fourth control members being exploited to recharge an accumulator of said electronic instrument.

12. A control device for a portable electronic instrument, including at least one control member mounted to be mobile in a support so as to have a translation travel along an axis of actuation, said control member being able to be actuated by pressure to be brought from a position called the non pushed-in position to a position called the pushed-in position, said control member including an electrically conductive stem arranged for allowing transmission of electric signals from or to the portable electronic instrument when said control member is brought into said pushed-in position, said control device including a first electric contact, electrically insulated from said stem, and capable of being actuated by the control member to generate a control signal in response, said control device further including a second electric contact capable of being actuated by the control member to establish, in the pushed-in position, an electric contact between said stem and an input/output line of the portable electronic instrument forming a transmission line of said electric signals, wherein said control device, in the non pushed-in position, said second electric contact establishes an electric connection between said stem and a determined electric potential thus preventing accumulation of electric charges on said stem.

* * * * *